United States Patent [19]

Horn

[11] Patent Number: 5,040,819

[45] Date of Patent: Aug. 20, 1991

[54] PLATE SKI SAFETY BINDING

[75] Inventor: Hans Horn, Berne, Switzerland

[73] Assignee: Skis Rossignol S.A., France

[21] Appl. No.: 482,539

[22] Filed: Feb. 21, 1990

[30] Foreign Application Priority Data

Feb. 27, 1989 [FR] France ..... 89 02516

[51] Int. Cl.[5] ..... A63C 9/081

[52] U.S. Cl. ..... 280/618

[58] Field of Search ..... 280/617, 618, 628, 630, 280/616

[56] References Cited

U.S. PATENT DOCUMENTS

| | | | |
|---|---|---|---|
| 3,937,480 | 2/1976 | Korger | 280/618 |
| 4,156,883 | 8/1979 | Weigl et al. | 280/618 |
| 4,266,805 | 5/1981 | Weigl et al. | 280/618 |
| 4,294,461 | 10/1981 | Eckart | 280/618 |
| 4,340,242 | 7/1982 | Gertsch | 280/618 |
| 4,758,017 | 7/1988 | Stritzl et al. | 280/618 |
| 4,858,946 | 8/1989 | Stritzl et al. | 280/618 |

*Primary Examiner*—Andres Kashnikow
*Assistant Examiner*—Richard Camby
*Attorney, Agent, or Firm*—Kane Dalsimer Sullivan Kurucz Levy Eisele and Richard

[57] ABSTRACT

The binding has a plate (1) mounted pivotably on the ski about a vertical pivot (3) and carrying, at the front, the front holding member (5) and at the rear a heel unit (8). The plate (1) is in two parts (4, 7), one of these parts being displaceable backwards relative to the part fastened to the pivot (3), against the action of a spring (45).

In the event of certain dangerous backward falls the boot may thus be freed from the front holding member.

19 Claims, 2 Drawing Sheets

PLATE SKI SAFETY BINDING

FIELD OF THE INVENTION

The subject of the present invention is a ski safety binding comprising a two-part plate mounted pivotably on the ski about a vertical pivot and carrying, at the front, front holding means intended to hold in place the front end of a boot and, at the rear, rear holding means intended to hold in place the heel of the boot.

PRIOR ART

Numerous embodiments of ski safety bindings are known having a pivoting plate. Such bindings are described, for example, in the following documents: AT-B-377,703, US-A-4,165,883, US-A-4,266,806, US-A4,758,017, US-A-4,294,461 and US-A-3,937,480. All these bindings have in common a stirrup at the front of the plate for holding in place the front part of the boot and a heel unit which releases, freeing the boot, in the event of a forward fall, the pivoting of the plate ensuring the freeing of the boot in the event of a fall causing the foot to twist sharply. In some of these bindings, the plate is in two parts, one carrying the heel unit and the other the front toe unit, so as to be able to adjust the distance between the heel unit and the front toe unit to the length of the sole of the boot. These bindings with a pivoting plate are known to offer a high degree of safety. However, in the event of a backward fall, there is no release. Now although backward falls are relatively rare, when they do happen they are generally serious. If a skier jumping over a bump lands heavily on the gliding surface of his skis, whilst leaning backwards, his leg muscles and knee joint are generally able to absorb the flexural force and in this case it is not necessary for the binding to release. Similarly, when skiing flat out, with a far back position, the binding may also be subjected to a substantial moment of force in the vertical plane and the binding must not release in this case either. On the other hand, if the skier falls on his back, his head pointing downhill, and slides backwards, and the ski is retained by his heel, the foot and the knee are subjected to dangerous forces and the binding should release in order to free the skier. Now in this case the binding is subjected to a compressive force towards the rear and to a torsional moment in the vertical plane.

Starting from these considerations, the object of the present invention is to provide a ski safety binding with a pivoting plate releasing in the event of a backwards fall, but only when the plate receives a compressive force towards the rear.

SUMMARY OF THE INVENTION

One of the parts of the plate of the binding according to the invention is a part fastened to the pivot and carries the front holding means and the other part, which carries the means for holding in place the heel, can be displaced backwards relative to the part fastened to the pivot, and counter to the action of elastic return means.

In the event of a backward fall, accompanied by compression towards the rear, the boot may move backwards, moving the movable part of the plate with it and compressing the elastic return means of the latter such that the front end of the boot is freed from its holding means.

The binding according to the invention has the further considerable advantage of enabling automatic adaptation to the length of the sole of the boot, which varies from one type to another for the same size, as a result of the elastic displacement of the movable part of the plate.

BRIEF DESCRIPTION OF THE DRAWINGS

The attached drawing shows, by way of example, an embodiment of the invention.

DESCRIPTION OF THE PREFERRED EMBODIMENT

Figure 1:
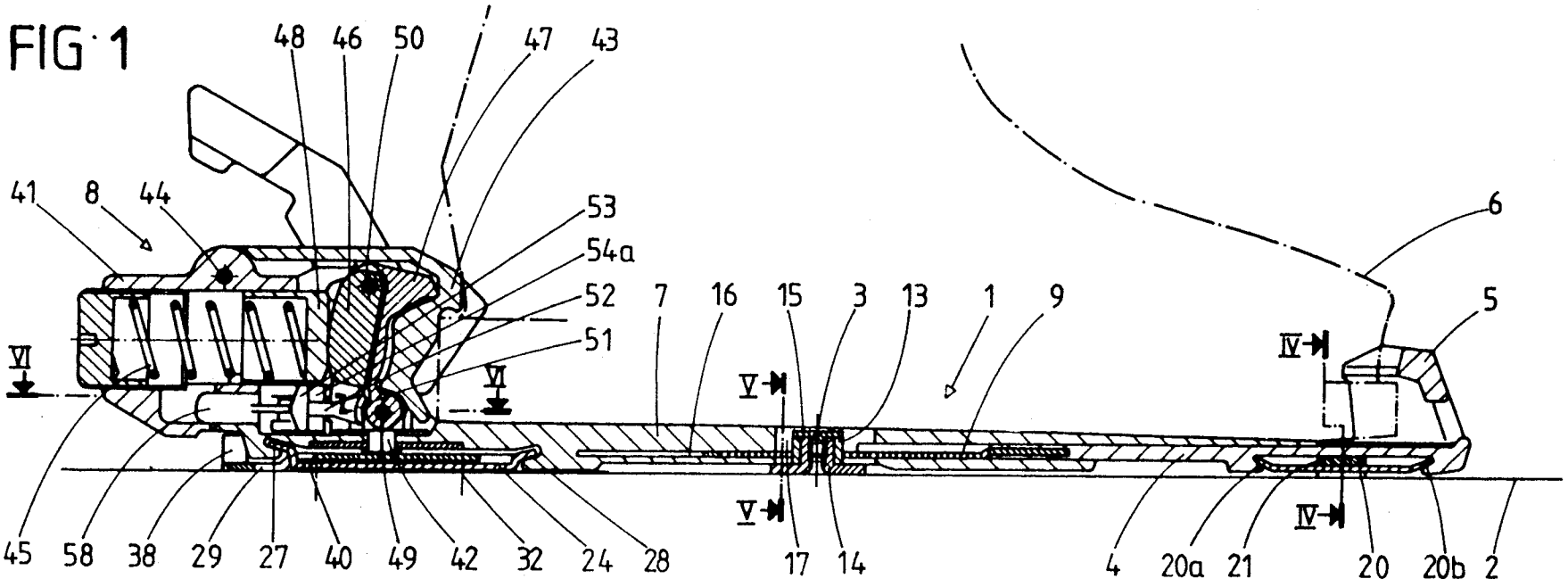
FIG. 1 is a view in axial cross-section along I—I in FIG. 2 of a plate binding provided with a heel unit.
Figure 2:
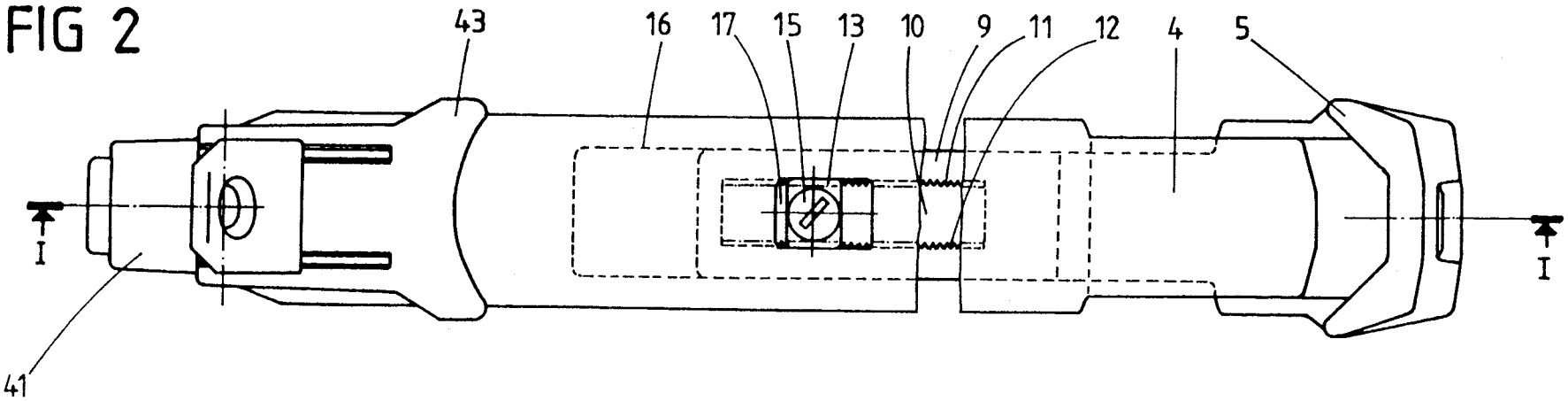
FIG. 2 is a plan view from above.

The binding shown comprises a plate 1 mounted pivotably on a ski 2 about a pivot 3. The plate 1 comprises a fixed part 4 formed in one piece with a fixed grip 5 at its end to hold in place the front part of a boot 6, and a movable part 7 carrying, at the rear, a heel unit 8 for holding in place the heel of the boot 6.

The fixed part 4 of the plate is here made from a light metal alloy and it is provided with a steel plate 9 having a longitudinal rectangular cutout 10, the long sides of which are provided with a toothing 11 and 12. This toothing engages with the teeth of a guide block 13 mounted pivotably on the cylindrical part of a cylindrical support 14 fastened to the ski 2. The guide block 13 is held in place on the support 14 by a screw 15. The toothed guide block 13 and the toothed cutout 10 enable the length to be adjusted between the pivot 3 and the front grip 5, in other words the length to be adjusted depending on the length of the boot.

The movable part 7 of the plate extends on and below the fixed plate 4. Its upper part tapers to a point near the grip 5 such that the boot 6 rests only on this part 7 of the plate. The part 7 of the plate extending below the part 4 serves for the vertical retention of this part 7 which has a horizontal slot 16 into which enters the toothed plate 9. The part 7 furthermore has a cutout 17 enabling, on the one hand, the displacement of the plate longitudinal relative to the pivot 3 and, on the other hand, access to the screw 15 in order to adjust the length of the binding. It can be seen in FIG. 3 that the support 14 is fastened to the ski by means of two screws 18 and 19.

Figure 3:
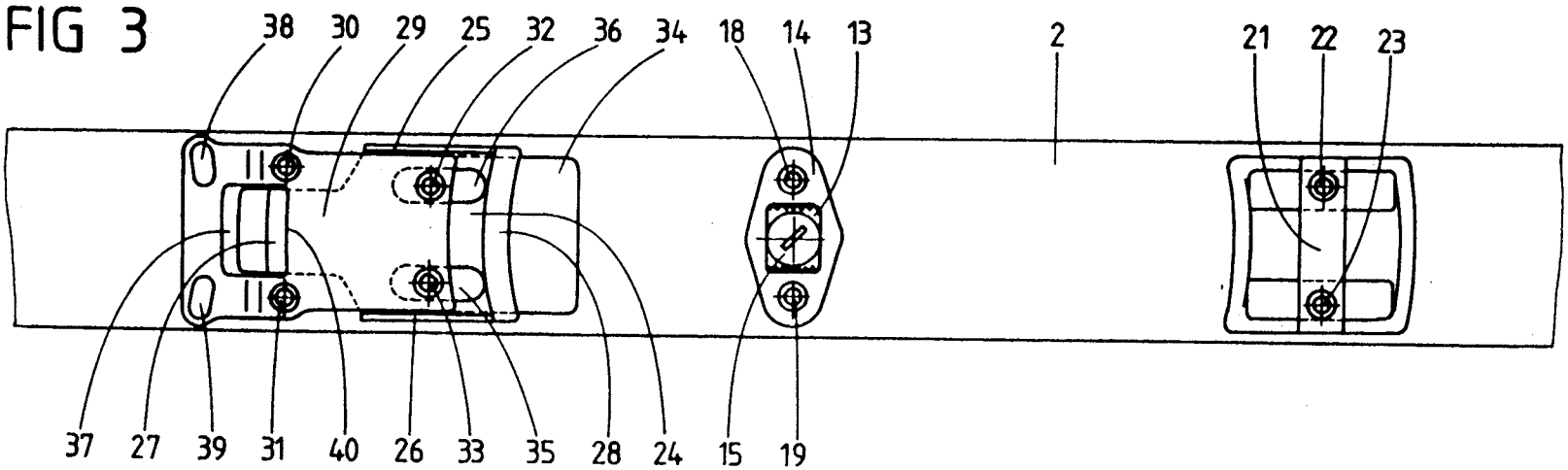
FIG. 3 is a plan view of the ski without the plate.
Figure 4:
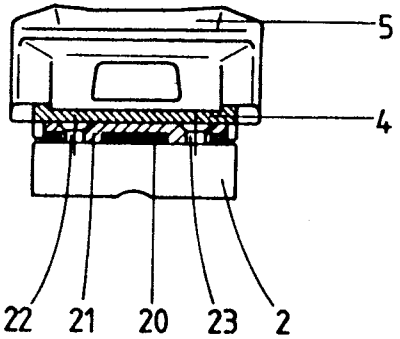
FIG. 4 is a view in cross-section along IV—IV in FIG. 1.

At the front, the fixed part 4 of the plate is retained vertically by a metal plate 20 with a generally rectangular shape, the edges **20*a* and 20*b* of which, transverse to the ski, are slightly raised obliquely and have the shape of arcs of a circle centered on the axis of the pivot 3. These raised edges 20*a* and 20*b* are engaged in recesses of the part 4 of the plate and can slide in these recesses. The plate 20 is itself retained by an arch 21 fastened to the ski by two screws 22 and 23 (FIGS. 3 and 4**).

At the rear, the movable part 7 of the plate is also retained vertically and guided by a metal plate 24 having two vertical edges parallel to the axis of the ski 25 and 26 and two sides, transverse to the ski, 27 and 28, the edges of which are raised in arcs of a circle centered on the axis of the pivot 3 and engaged in recesses of the part 7 in which they can slide when the plate pivots. The plate 24 is retained vertically by a plate 29 having two levels, one of which extends over the plate 24. This plate 29 is fastened to the ski by means of four screws 30, 31, 32 and 33. The screws 32 and 33 traverse the plate 24 through two oblong cutouts 35 and 36 so as to enable the plate 24 to be displaced axially. A metal plate having a low coefficient of friction 34 is arranged between the plate 24 and the ski facilitate the displacement of the plate 24. The plate 29 has a cutout 37 through which passes the raised rear edge 27 of the plate 24. At the rear, the plate 29 carries two stops 38 and 39 arranged on either side of a longitudinal axis of the binding and symmetrically about this axis. The front edge 40 of the cutout 37 serves as a stop for the plate 24.

Figure 6:
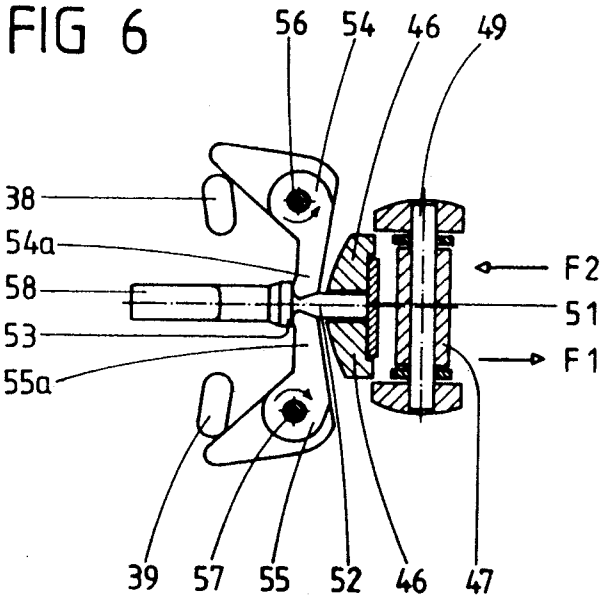
FIG. 6 is a partial and enlarged view of a cross-section along VI—VI in FIG. 1 illustrating the operation of the binding in a backward fall.
Figure 5:
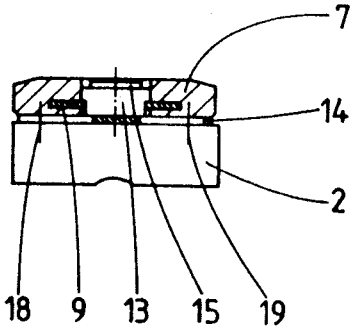
FIG. 5 is a view in cross-section along V—V in FIG. 1.

The heel unit 8 comprises a body 41 mounted pivotably on the movable part 7 of the plate by means of a vertical pivot 42. This heel unit comprises a grip 43 articulated on the body 41 about a pin 44 in order to hold in place the heel of the boot. This grip 43 is held in place elastically by means of a spring 45 acting on the grip 43 via a two-lever 46/47 system and a piston 48. The lever 47 is articulated about a transverse horizontal pin 49 situated just above the pivot 42. The lever 46 is itself articulated on the lever 47 at its lower part about a transverse pin 50. The lower split end of the lever 46 bears against the head 51 of a rod 52 directed in the axis of the binding and provided with a bearing surface 53, against which bear the ends 54*a* and 55*a* of two angled levers 54 and 55 mounted on a vertical pin 56 and 57 respectively on the movable part 7 of the plate (FIG. 6). The rod 52 ends in a lock 58 intended to lock the heel unit in rotation on the plate. Consequently, the spring 45 pushes, via the lever 46, the head 51 in the direction of the arrow F1, the levers 54 and 55 therefore tending to rotate in the direction indicated by the arrows, pressing against the fixed stops 38 and 39. The reaction of the stops 38 and 39 therefore tends to push the part 7 of the plate forwards, such that the part 27 of the plate 24 abuts against the edge 40.

In the event of a backward fall with compression towards the rear, a force F2 is exerted on the heel unit 8. This force F2 opposes the force Fl exerted by this spring 45. The movable part 7 of the plate moves backwards, compressing this spring 45. The boot 6 moves backwards with the movable part 7 of the plate and is disengaged from the front grip 5 so as to be freed completely from the binding.

The abutting could take place at the center, with the rear end of the cutout 17 against the pivot 3.

This system can, of course, be used with all types of rear binding, whether it be a heel unit or another type of binding, for example a binding device integral with the sole of the boot. In all cases, the longitudinal elastic return device of the plate could consist of a single fixed stop and a spring arranged between this stop and the plate on the ski or on the movable part of the plate.

As distinct from prior one-piece plate bindings, the binding according to the invention has the further advantage of not requiring accurate adjustment of the distance between the heel unit and the front toe unit, since an excessively short distance is automatically compensated for by the backward movement of the movable part 7 of the plate and the compression of the spring 45, as is the case in bindings with independent heel units and front toe units, and without a plate. The binding is therefore automatically adapted to the length of the sole of the boot.

It should be noted that it is not absolutely necessary for the movable part of the plate to be held in abutment in the absence of a boot. Play could exist, even though the return spring is slack. Furthermore, the stop means could be provided in the elastic return means.

I claim:

1. A ski safety binding comprising a two-part plate (1) mounted pivotably on the ski about a vertical pivot (3) and carrying, at the front, front holding means (5) intended to hold in place the front end of a boot and, at the rear, rear holding means (8) intended to hold in place the heel of the boot, wherein elastic return means are provided for pushing the plate forward, one of the parts (4) of the plate is fastened to the pivot (3) and carries the front holding means (5) and the other part (7) of the plate, which carries the means for holding in plate the heel, can be displaced backwards relative to the part fastened to the pivot, counter to the action of said elastic return means (45).

2. The binding as claimed in claim 1, wherein the elastic return means consisting of a spring mounted on the ski and pushing the other part of plate forwards.

3. The binding as claimed in claim 1, having a heel unit (8) provided with an articulated grip (43) held against the heel by elastic return means comprising a spring (45), wherein the said spring simultaneously forms the spring for the longitudinal return of the two-part plate.

4. The binding as claimed in claim 3, wherein the heel unit (8) is mounted pivotably on the two-part plate in a horizontal plane and comprises a mechanism (46, 47) for transmitting force between said spring and the grip, and the plate or the body (41) of the heel unit is provided with two levers (54, 55) pivoted at a mid-point about two vertical pins, symmetrically on either side of the longitudinal center axis of the two-part plate, these levers bearing on the one hand against two fixed stops (38, 39) respectively, and on the other hand against the said force-transmission mechanism.

5. The binding as claimed in claim 1, wherein it comprises means (9, 13, 15) for adjusting the point of fastening to the pivot of the one part of plate fastened to the pivot.

6. The binding as claimed in claim 1, wherein the other part of the plate (7) is guided in rotation, at the rear, by a guide piece (24) mounted slidably on the ski.

7. The binding as claimed in claim 6, wherein the said guide piece (24) consists of a second plate having, at the front, and at the rear, a raised edge in the arc of a circle, engaged in a recess with the corresponding shape of the other part of the plate.

8. The binding as claimed in claim 1, wherein it comprises stop means (40) against which the other part (7) of the plate is held by the elastic return means in the absence of a boot.

9. A ski safety binding comprising a two-part plate (1) mounted pivotably on the ski about a vertical pivot (3) and carrying, at the front, front holding means (5) intended to hold in place the front end of a boot and, at the rear, rear holding means (8) intended to hold in place the heel of the boot, wherein one of the parts (4) of the plate is fastened to the pivot (3) and carries the front holding means (5) and the other part (7) of the plate, which carries the means for holding in place the heel, can be displaced backwards relative to the part fastened to the pivot, counter to the action of elastic return means (45), wherein the elastic return means pushing the plate forward, said rear holding means (8) provided with an articulated grip (43 held against the heel of the foot by said elastic return means, said elastic return means comprising a spring (45), wherein said spring simultaneously forms the spring for the longitudinal return of the two part plate.

10. The binding as claimed in claim 9, wherein the heel unit (8) is mounted pivotably on the plate in a horizontal plane and comprises a mechanism (46, 47) for transmitting force between said spring and the grip, and two levers being (54, 55) pivoted at a mid-point about two vertical pins, symmetrically on either side of the longitudinal center axis of the plate, these levers bearing on the one hand against two fixed stops (38, 39) respectively, and on the other hand against the said force-transmission mechanism.

11. The binding as claimed in claim 9, wherein it comprises means (9, 13, 15) for adjusting the point of fastening to the pivot of the one part of the plate fastened to the pivot.

12. The binding as claimed in claim 9, wherein the other part of the plate (7) is guided in rotation, at the rear, by a guide piece (24) mounted slidably on the ski.

13. The binding as claimed in claim 12, wherein the said guide piece (24) consists of a second plate having, at the front, and at the rear, a raised edge in the arc of a circle, engaged in a recess with the corresponding shape of the movable part of the plate.

14. The binding as claimed in claim 9, wherein it comprises a stop means (40) against which the other part (7) of the plate is held by the elastic return means in the absence of a boot.

15. The binding as claimed in claim 1, wherein the elastic return means consists of a spring mounted on the other part of the plate and pushing the plate forwards.

16. The binding as claimed in claim 9, wherein the elastic return means is a spring mounted on the ski.

17. The binding as claimed in claim 9, wherein the elastic return means is a spring mounted on the other part of the plate.

18. The binding as claimed in claim 10, wherein the two part plate is provided with the two levers.

19. The binding as claimed in claim 10, wherein a body 41 is provided with the two levers.

* * * * *